US009870883B2

(12) United States Patent
Abe et al.

(10) Patent No.: US 9,870,883 B2
(45) Date of Patent: Jan. 16, 2018

(54) INPUT DEVICE AND ELECTRONIC EQUIPMENT

(71) Applicant: FUJITSU LIMITED, Kawasaki-shi, Kanagawa (JP)

(72) Inventors: Takashi Abe, Kawasaki (JP); Masaki Ishikawa, Yokohama (JP); Takashi Iijima, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/795,040

(22) Filed: Jul. 9, 2015

(65) Prior Publication Data

US 2016/0027597 A1 Jan. 28, 2016

(30) Foreign Application Priority Data

Jul. 24, 2014 (JP) ..... 2014-150812

(51) Int. Cl.
*H01H 9/26* (2006.01)
*H01H 13/72* (2006.01)
*H01H 13/7065* (2006.01)

(52) U.S. Cl.
CPC ... *H01H 13/7065* (2013.01); *H01H 2221/044* (2013.01); *H01H 2221/054* (2013.01); *H01H 2231/026* (2013.01); *H01H 2231/042* (2013.01)

(58) Field of Classification Search
CPC ..... H01H 13/7065; H01H 2221/044; H01H 2231/042; H01H 2221/054; H01H 2231/026
See application file for complete search history.

(56) References Cited

U.S. PATENT DOCUMENTS 8,841,569 B2 * 9/2014 Liang ..... G06F 1/1684 200/343
2006/0113176 A1 * 6/2006 Shimizu ..... H01H 13/70 200/343

(Continued)

FOREIGN PATENT DOCUMENTS

CN 202018902 U 10/2011
JP 2007-80644 A 3/2007

(Continued)

OTHER PUBLICATIONS

Office Action dated Jan. 4, 2017, issued in counterpart Chinese Patent Application No. 201510437823.5, with English translation. (12 pages).

*Primary Examiner* — Edwin A. Leon
*Assistant Examiner* — Lheiren Mae A Caroc
(74) *Attorney, Agent, or Firm* — Westerman, Hattori, Daniels & Adrian, LLP

(57) ABSTRACT

An input device includes a housing which has an opening, button parts which are exposed from the opening and which are pressed down in a first direction, a support component which has a support part to support the button parts, a first surface to face the housing, a second surface provided opposite to the first surface, and fixation parts provided at a first distance from the support part and fixed to the housing on a side of the first surface, a substrate which is provided so as to face the second surface of the support component, and a component which is inserted into the substrate in the first direction and which presses a specified area of the second surface, positioned at a second distance shorter than the first distance from the support part, toward the housing in a direction opposite to the first direction.

6 Claims, 17 Drawing Sheets

(56) References Cited

U.S. PATENT DOCUMENTS

| | | | | |
|---|---|---|---|---|
| 2007/0209920 | A1* | 9/2007 | Yanagi | G06F 3/0231 200/5 A |
| 2012/0250251 | A1 | 10/2012 | Liang et al. | |
| 2013/0250509 | A1 | 9/2013 | Tachikawa et al. | |

FOREIGN PATENT DOCUMENTS

| | | | |
|---|---|---|---|
| JP | 2011-22664 | A | 2/2011 |
| JP | 2013-200677 | A | 10/2013 |

* cited by examiner

INPUT DEVICE AND ELECTRONIC EQUIPMENT

CROSS-REFERENCE TO RELATED APPLICATION

This application is based upon and claims the benefit of priority of the prior Japanese Patent Application No. 2014-150812, filed on Jul. 24, 2014, the entire contents of which are incorporated herein by reference.

FIELD

The embodiments discussed herein are related to an input device and electronic equipment.

BACKGROUND

Some input devices such as keyboards that are used for input into notebook-size personal computers (PCs), tablet terminals, portable information terminals, and the like have a touch pad and click buttons. The touch pad refers to a pointing device in which a pad is substituted for operations for moving a mouse. The click buttons correspond to left and right click buttons on the mouse. The touch pad and the click buttons are provided in combination. (Japanese Laid-open Patent Publication No. 2011-22664)

A click button is conceivable that has a button part to be pressed down by a user and that has a structure in which an arm part supporting the button part extends from a base part having fixation parts to be fixed to a housing. When the button part is pressed down by a user, in the click button, the arm part is curved into a shape of an arch so as to press down a switch provided in a press-down direction from the click button and input of left click or right click is thereby carried out.

SUMMARY

According to an aspect of the invention, an input device includes a housing which has an opening, button parts which are exposed from the opening and which are pressed down in a first direction, a support component which has a support part to support the button parts, a first surface to face the housing, a second surface provided opposite to the first surface, and fixation parts provided at a first distance from the support part and fixed to the housing on a side of the first surface, a substrate which is provided so as to face the second surface of the support component, and a component which is inserted into the substrate in the first direction and which presses a specified area of the second surface, positioned at a second distance shorter than the first distance from the support part, toward the housing in a direction opposite to the first direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
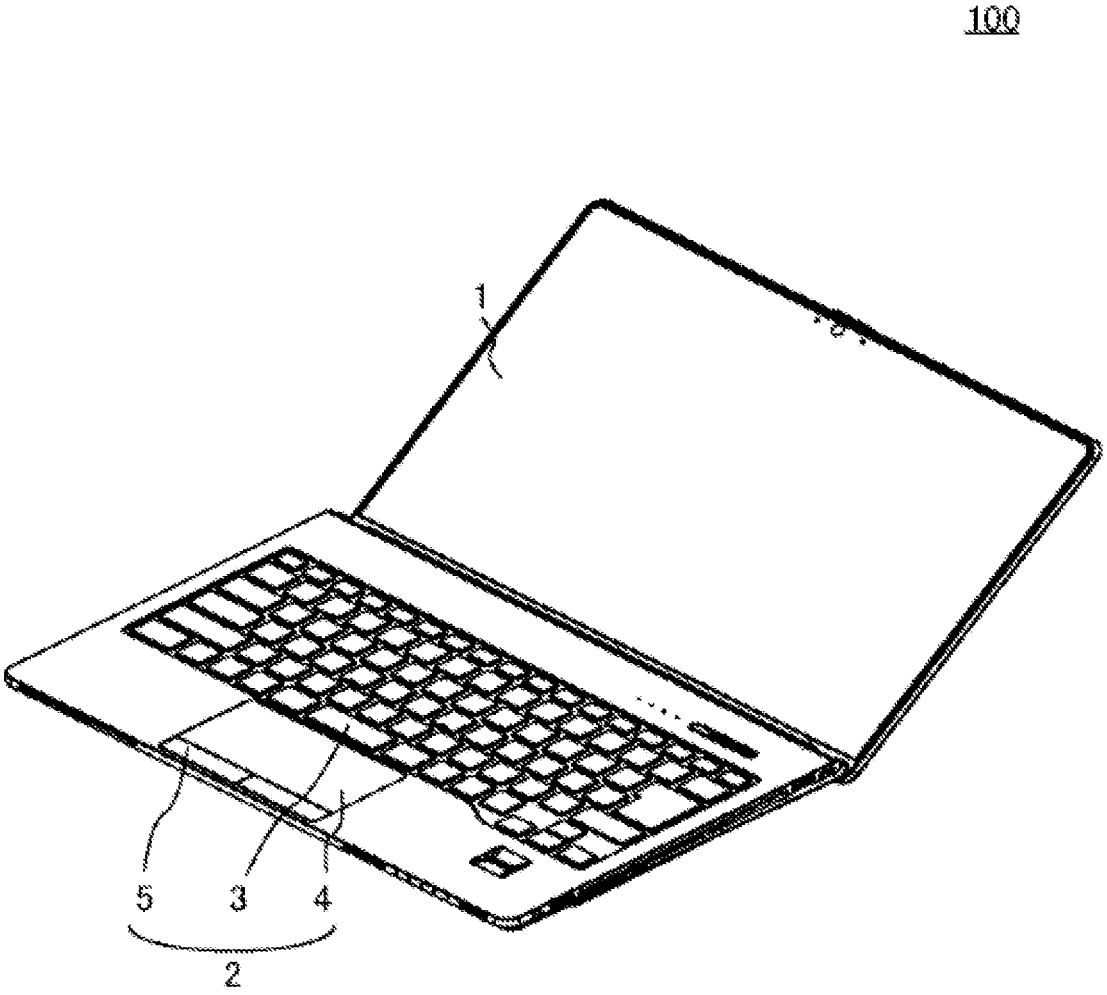
FIG. 1 is a diagram illustrating an appearance of a notebook-size PC according to a first embodiment.

While inventing the present embodiments, observations were made regarding a related art. Such observations include the following, for example.

In order that the switch may stably be pressed down by press-down on the button part, the arm part is desired to be curved across a specified length upon the press-down. Depending on positions where the fixation parts of the base part are fixed to the housing, however, not only the arm part but the base part may deform upon the press-down on the button part. In order that the arm part may be curved across the specified length, a position on the base part to which the arm part is connected is requested to be fixed.

It may be impossible, however, to provide the fixation part in the position on the base part to which the arm part is connected. In this case, not only the arm part but the base part may deform upon the press-down on the button part. In a configuration in which a touch pad and the click buttons are provided in combination, for instance, it is demanded to provide the fixation parts of the base part so as to avoid an area of the touch pad provided on the housing and it is accordingly impossible to provide the fixation parts in the positions on the base part to which the arm parts are connected. Deformation in the base part changes degree of curve in the arm part and thus may make it impossible to stably press down the switch. A clearance between the button part of the click button and the switch is so severely designed that stable click is prohibited by change in the degree of the curve in the arm part.

It is conceivable that a rib protruding from the base part of the click button is provided and that the base part is kept from deforming by contact of the rib with a substrate fixed to the housing.

A structure in which the rib is used so as to be in contact with the substrate, however, occupies a specified area on the substrate and affects utilization of a mounting area on the substrate. This makes a large problem in terminals such as notebook-size PCs of which decrease in thicknesses, weights, and sizes is demanded. In particular, components having large heights are hindered from being provided on the substrate under a keyboard because receiving components are provided on a part of the substrate under the keyboard in order not to impair key response on the keyboard and thus circuits have to be made to close up in an area on the substrate under the click buttons and the touch pad.

The embodiments discussed herein have been provided in consideration of the above problem and are intended for providing an input device and electronic equipment that enable stable click and effective utilization of substrate area.

In input devices and electronic equipment for notebook-size PCs, tablet terminals, portable information terminals, and the like, substrates are dispersed in order to make mounted circuits, hard disks, batteries, optical disks, fans, and the like close up for reduction in size of the devices. For dispersion of the substrates, the substrates are classified into a main substrate and sub-substrates. For connection between the main substrate and the dispersed sub-substrates, connectors of such types as are inserted into and disconnected from the main substrate and the sub-substrates in vertical directions are used in order to save as much space as possible and in order to transmit high-speed signals.

Herein, the connectors that provide electrical connection between the main substrate and the sub-substrates are taken notice of. The connectors are inserted into and disconnected from connectors provided on the substrates in the vertical directions. Conventionally, such holding structures as ribs are provided on housing side, for instance, other than the substrates in order to prohibit accidental disengagement of the connectors in the vertical directions. Accidental disconnection of the connectors has been inhibited by provision of the ribs on a lower housing. A connector provided on a substrate is used as a holding component for a base part of click buttons and an input device and electronic equipment that suppress impairment in efficient mounting on the substrates and in click feeling are thereby provided.

A structure of the holding component for the base part of the click buttons is not limited to the connector and a component that is inserted and disconnected with respect to the substrate in the vertical directions and that demands a structure for holding from an element other than the substrate may be used therefor. Such a component as a button battery mounted on the substrate may be used therefor, for instance.

Hereinbelow, embodiments of the input device and the electronic equipment will be described in detail based on the drawings. The embodiments impose no limitations on the disclosed technology.

First Embodiment

Description on a first embodiment will be given with use of a notebook-size PC 100 as an example of the input device and the electronic equipment.

FIG. 1 is a diagram illustrating an appearance of the notebook-size PC 100 according to the first embodiment. In FIG. 1, the notebook-size PC 100, a display part 1, an input part 2, a keyboard 3, a touch pad 4, and click buttons 5 are illustrated. As illustrated in FIG. 1, the notebook-size PC 100 includes the display part 1 that displays a display screen and the input part 2. The input part 2 includes the keyboard 3 through which characters and the like are inputted, the touch pad 4, and the click buttons 5. The touch pad 4 is a pointing device that is substituted for operations for moving a mouse. By being pressed down by a user, the click buttons 5 each press down a switch in a housing that will be described later and activate the same functions as a left or right click button on a mouse activates.

Figure 2:
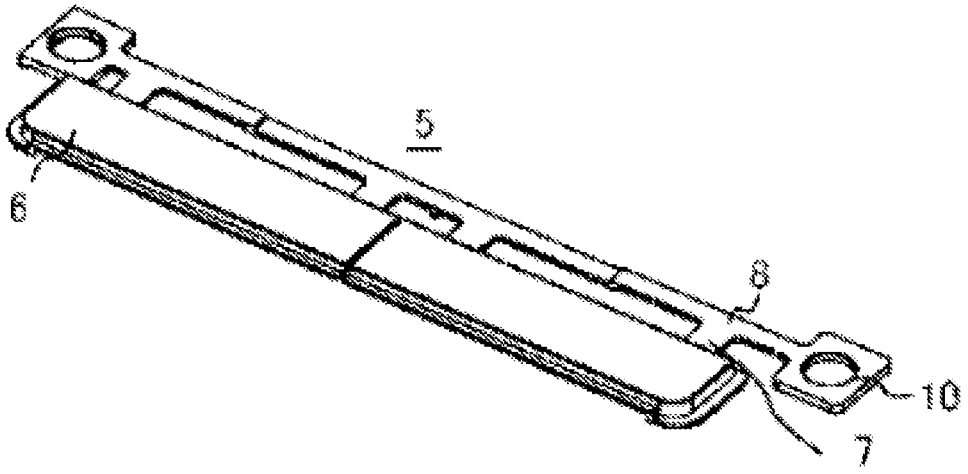
FIG. 2 is a diagram illustrating an example of click buttons.

FIG. 2 is a diagram illustrating an example of the click buttons 5. As illustrated in FIG. 2, the click buttons 5 include button parts 6, and arm parts 7 and a base part 8 that are support parts to support the button parts 6. The button parts 6 are each pressed down by a click by a user, so that a contact part provided opposite to a face that is pressed down presses down the switch provided in the housing. The contact part will be described with use of FIG. 5.

The click buttons 5 are pressed down by click operations that are rotational motions with respect to fulcrums in front and thus press-down with rotation with respect to fulcrums at back of the button parts 6 has to be carried out in consideration of click feeling the user feels. Therefore, fixation parts 10 for fixation to the housing are provided at back of the button parts. The fixation parts 10 for the click buttons 5 are fixed to the housing in areas outside an area of the touch pad 4 provided on the housing because the click buttons 5 are provided along with the touch pad 4. That is because it is impossible to use a structure of the fixation by screws from inside of the housing, in the area of the touch pad 4. The arm parts 7 extend from a side face of the base part 8 and support the button part 6.

In the click buttons 5 illustrated in FIG. 2, the button parts 6 are supported by the four arm parts 7 extending from the side face of the base part 8. Herein, the arm part 7 that is pressed against the housing by a connector is the arm part 7 that is rightmost in FIG. 2.

A top surface of the base part 8 is a surface that faces the housing when the base part 8 is fixed with respect to the housing. When the button part 6 is pressed down, the arm part 7 is curved and the contact part of the button part 6 is thereby brought into contact with the switch 18. Length of the arm parts 7 is determined based on a distance from which the contact part of the button part 6 is brought into contact with the switch 18.

Though the example of the click buttons 5 in which the button parts 6, the base part 8, and the arm parts 7 are integrally molded is illustrated in FIG. 2, the click buttons 5 are not limited to the example in which the button parts 6, the base part 8, and the arm parts 7 are integrally molded. Plastic such as PC/ABS or the like is used as material of the click buttons 5. The material is determined in accordance with forces of the press-down by users, the click feeling, weight and cost of the notebook-size PC 100, and the like.

A problem in that not only the arm part 7 but the base part 8 deforms upon the press-down on the button part 6 will be described with use of FIG. 3.

Figure 3:
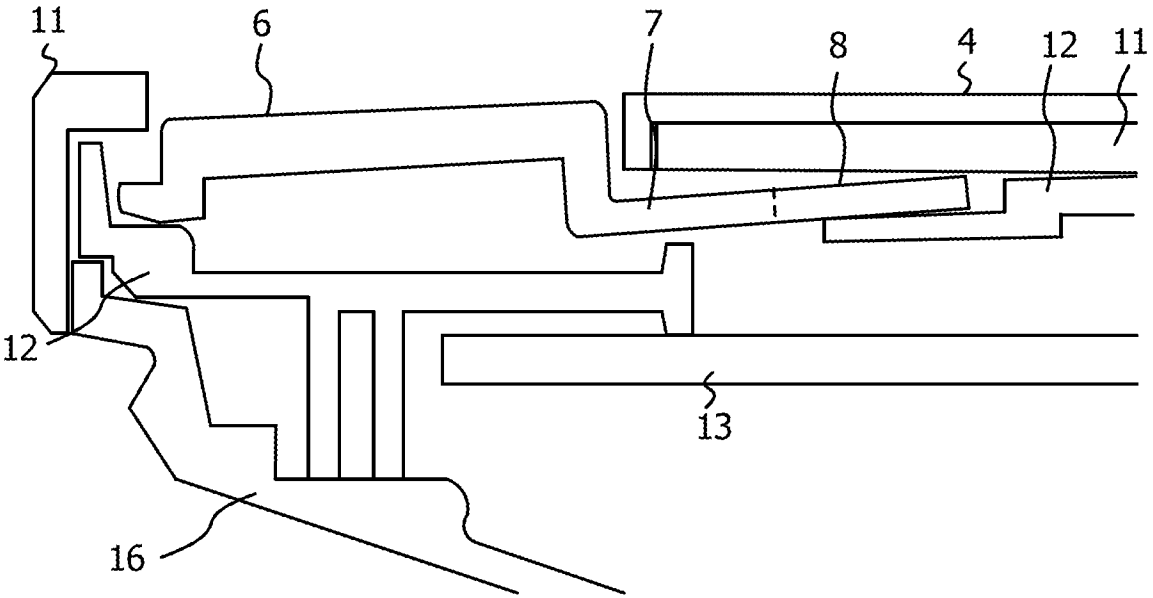
FIG. 3 is a sectional view of an input part taken through an arm part.

FIG. 3 is a sectional view of the input part 2 taken through the arm part 7 and illustrates deformation of the click button 5 upon the press-down on the button part 6. In FIG. 3, an upper housing 11, the touch pad 4, a lower housing 16, the button part 6, the arm part 7, and the base part 8 of the click button 5, a holding component 12, and a main substrate 13 are illustrated. Details on the holding component 12 and the main substrate 13 will be described later.

As illustrated in FIG. 3, the click button 5 is fixed to the upper housing 11 by the fixation part 10 that is in front of the base part 8 in FIG. 3 and that has been described above. It may be impossible, however, to provide a structure that fixes parts of the base part 8 to which the arm parts 7 are connected, due to positional relation with the touch pad 4 or the like. When the button part 6 is pressed down in this case, the button part 6 deforms not only the arm part 7 to be curved but also the base part 8. Deformation in the base part 8 changes degree of curve in the arm part 7 and thus may make it impossible to stably press down the switch 18. A clearance between the button part 6 of the click button 5 and the switch 18 is so severely designed that a problem is caused in that stable click is prohibited by change in the degree of the curve in the arm part 7.

A structure in which a connector provided on the substrate is used as the holding component for the base part 8 of the click buttons 5 will be described below.

A configuration of the input part 2 herein will be described with use of FIGS. 4 through 6.

Figure 4:
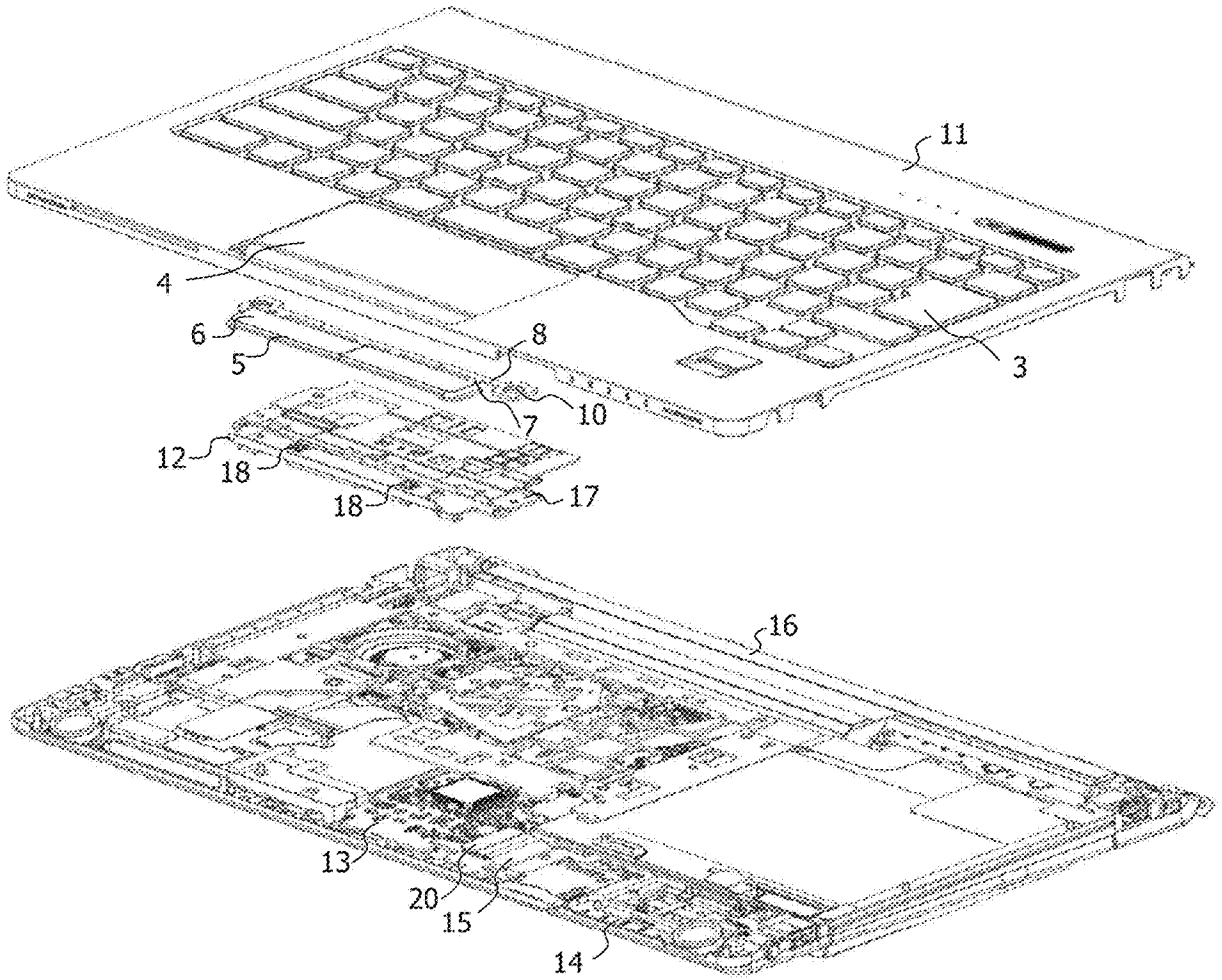
FIG. 4 is an assembly diagram illustrating the input part.

FIG. 4 is an assembly diagram illustrating the input part 2. In FIG. 4, the upper housing 11, the keyboard 3, the touch pad 4, the click buttons 5, the holding component 12, the main substrate 13, a sub-substrate 14, a flexible cable 15, and the lower housing 16 are illustrated. The input part 2 includes the upper housing 11, the click buttons 5, the holding component 12 which is fixed to the housing with the click buttons 5 therebetween, the main substrate 13 on which electronic components are installed, the sub-substrate 14 on which electronic components are installed, the flexible cable 15 which provides electrical connection between the main substrate 13 and the sub-substrate 14, and the lower housing 16.

The keyboard 3 and the touch pad 4 are provided on the upper housing 11. The holding component 12 includes fixation parts 17 that are fixed to the upper housing 11 with the click buttons 5 therebetween and the switches 18 that are pressed down in contact with the contact parts of the click buttons 5 by press-down by a user. By being pressed down, the switches 18 each activate the same functions as the left or right click button on the mouse activates.

The flexible cable 15 has two connectors and two connector plates that are used for protection, insertion, and disconnection of the two connectors, respectively. One connector plate 20 of the two connector plates is illustrated in FIG. 4. The flexible cable 15 that provides the connection between the main substrate 13 and the dispersed sub-substrate 14 saves as much space as possible and is capable of transmitting high-speed signals. The connectors of the flexible cable 15 are of a type that is inserted into and disconnected from a connector of the main substrate 13 and a connector of the sub-substrate 14 in vertical directions. The lower housing 16 is attached to the upper housing 11 so that the click buttons 5, the holding component 12, the main substrate 13, the sub-substrate 14, and the flexible cable 15 are housed.

Figure 5:
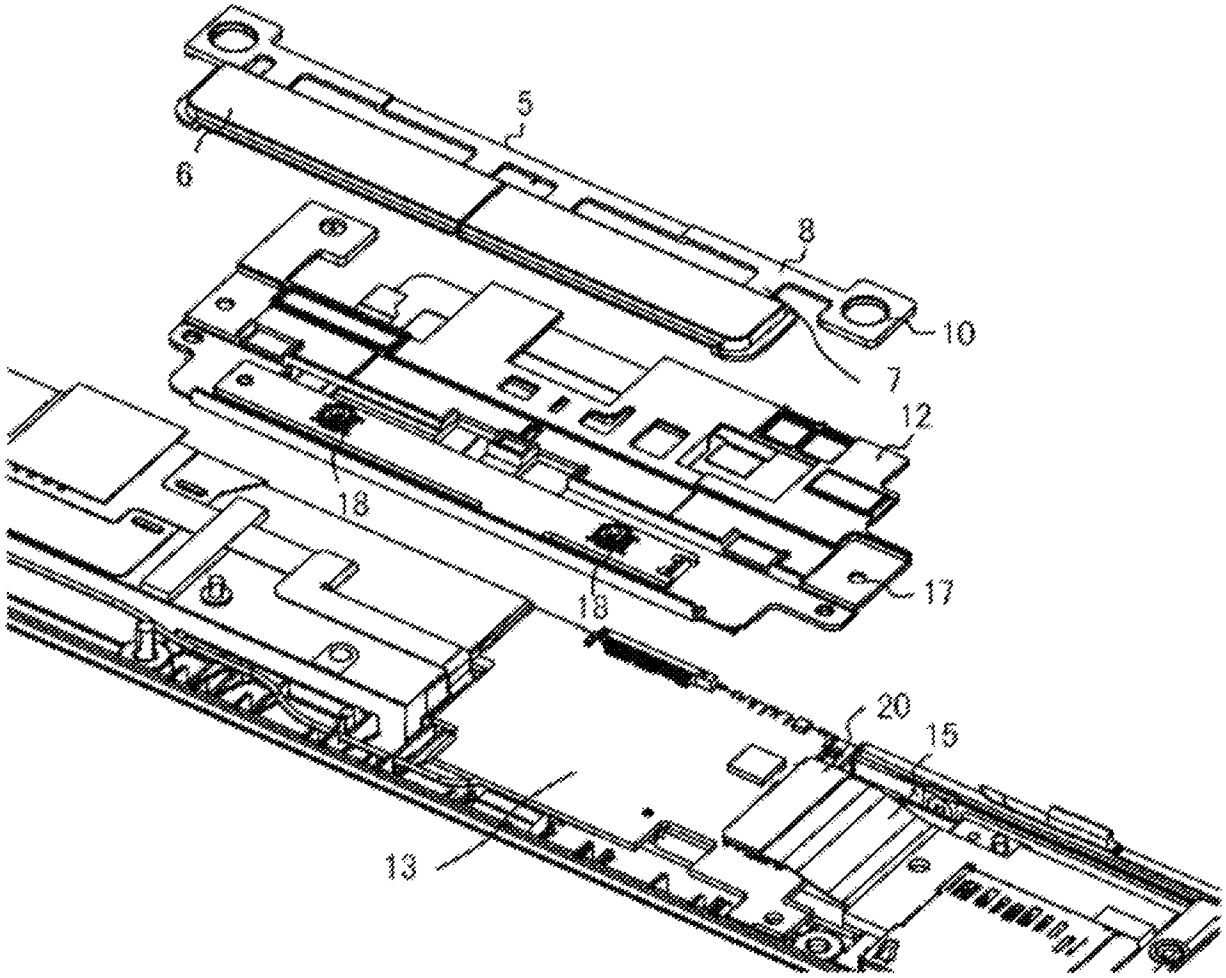
FIG. 5 is an enlarged view in which the click buttons, a holding component, a main substrate, and a flexible cable are enlarged.
Figure 6:
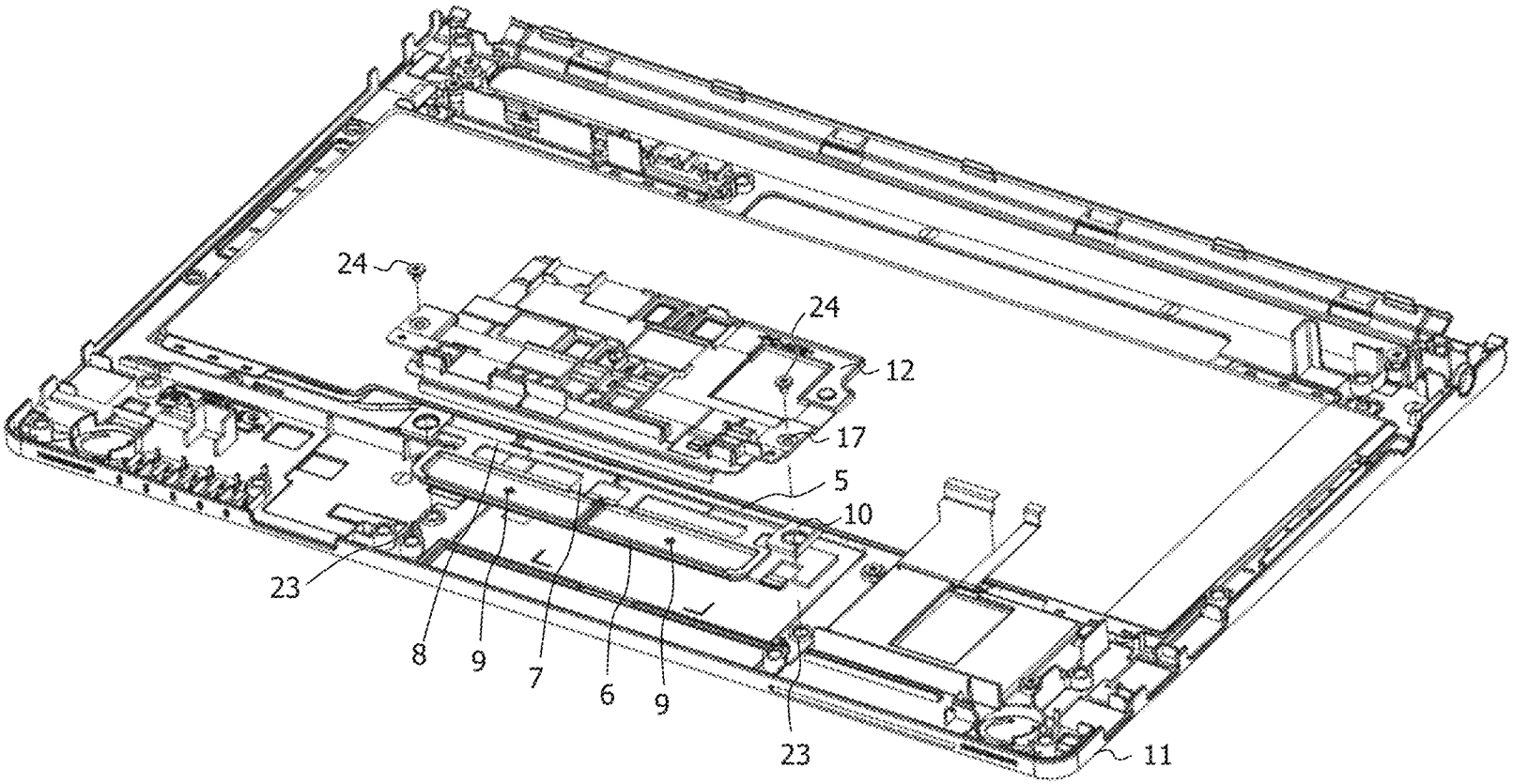
FIG. 6 is an assembly diagram illustrating an upper housing, the click buttons, and the holding component.

A view in which the click buttons 5, the holding component 12, the main substrate 13, and the flexible cable 15 that are illustrated in FIG. 4 are enlarged is illustrated in FIG. 5 and positional relation thereamong will be described with use of FIG. 5. FIG. 5 is the enlarged view in which the click buttons 5, the holding component 12, the main substrate 13, and the flexible cable 15 are enlarged. In FIG. 5, the click buttons 5, the holding component 12, the main substrate 13, and the flexible cable 15 are illustrated.

The fixation parts 10 of the click buttons 5 are assembled with the fixation parts 17 of the holding component 12 and are fixed to the upper housing 11 by screws. The switches 18 on the holding component 12 are provided at positions corresponding to the contact parts of the button parts 6. The connector plate 20 is mounted on the main substrate 13 so as to be directly beneath the part of the base part 8 to which the arm part 7 is connected, in assembled state.

Subsequently, relation in which the holding component 12 and the click buttons 5 are assembled with the upper housing 11 by use of the screws 24 will be described from a viewpoint on back side of the notebook-size PC 100. FIG. 6 is an assembly diagram illustrating the upper housing 11, the click buttons 5, and the holding component 12. FIG. 6 is a view as seen looking from a side of the lower housing 16, that is, from the back side of the notebook-size PC 100. In FIG. 6, the holding component 12, the click buttons 5, and the upper housing 11 are illustrated. The click buttons 5 include the contact parts 9 on the back side of the button parts 6. The fixation parts 10 of the click buttons 5 are assembled with the fixation parts 17 of the holding component 12 and are fixed to fixation parts 23 of the upper housing 11 by the screws 24.

Subsequently, a configuration that enables stable click and effective utilization of the substrates by pressure by a connector 19 against the support parts of the click buttons 5 will be described with use of FIGS. 7 through 11.

Figure 7:
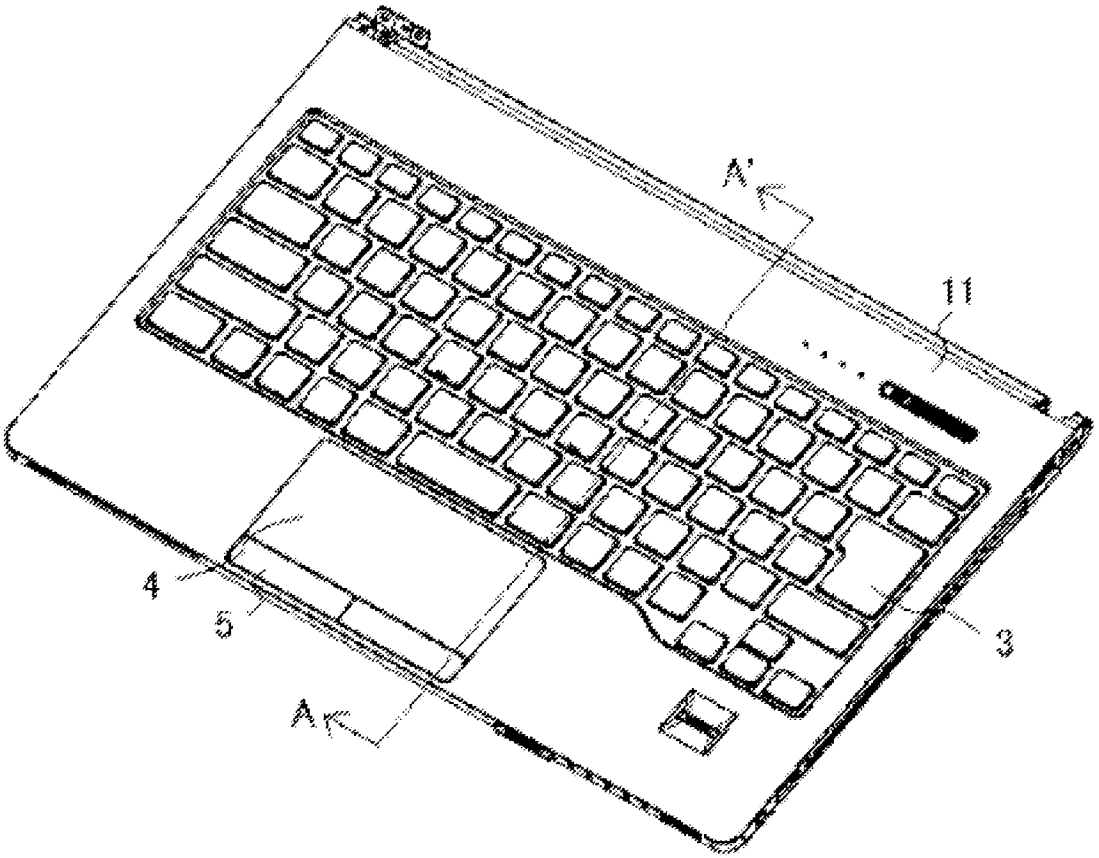
FIG. 7 is an external perspective view of the input part.

FIG. 7 is an external perspective view of the input part 2. In FIG. 7, the upper housing 11, the keyboard 3, the touch pad 4, and the click buttons 5 are illustrated. A sectional view taken along line VIII-VIII illustrated in FIG. 7 is illustrated in FIG. 8.

Figure 8:
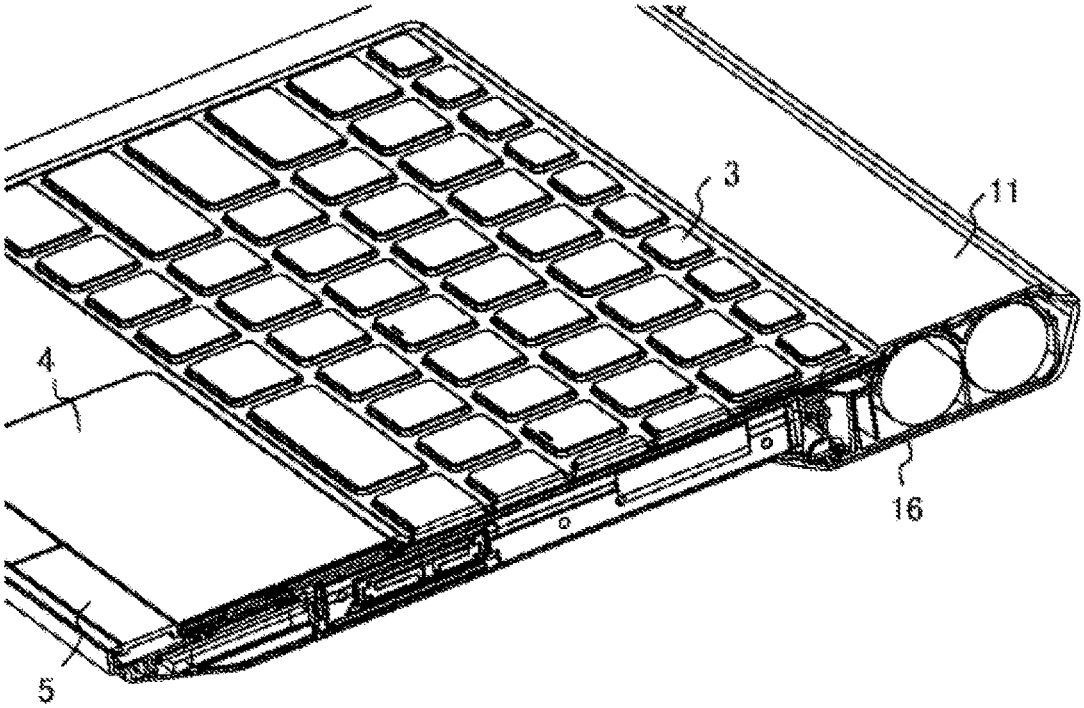
FIG. 8 is a perspective view illustrating a section of the input part.

FIG. 8 is a perspective view illustrating a section of the input part 2. FIG. 8 is a diagram for illustrating an overall view of a configuration of inside of the housing that will be described later and that is cut along the above-mentioned VIII-VIII section. In FIG. 8, the upper housing 11, the lower housing 16, the keyboard 3, the touch pad 4, and the click buttons 5 are illustrated. As illustrated in FIG. 8, the click buttons 5 are provided in front of the touch pad 4. With use of the section illustrated in FIG. 8, positional relation among the upper housing 11, the click buttons 5, the holding component 12, the main substrate 13, the connector plate 20, and the lower housing 16 will be described with use of FIG. 9.

Figure 9:
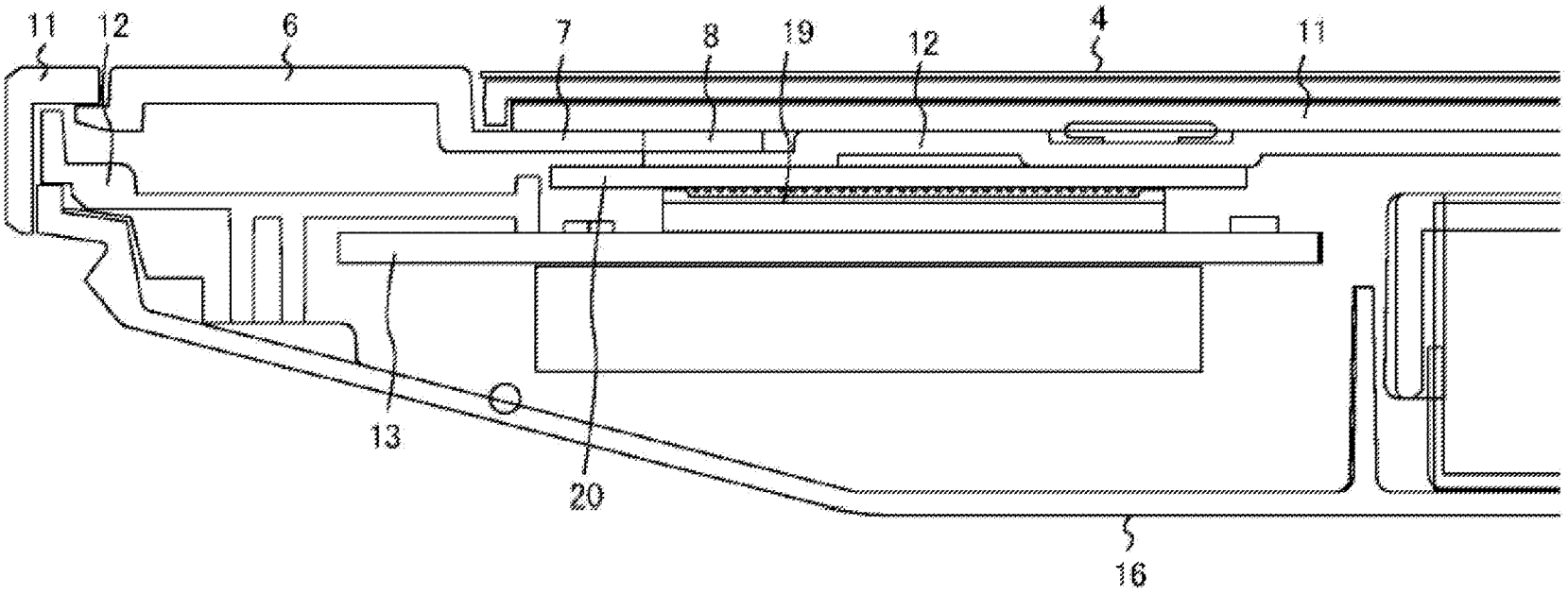
FIG. 9 is a side view illustrating the section of the input part.

FIG. 9 is a side view illustrating the section of the input part 2. In FIG. 9, the upper housing 11, the touch pad 4, the button part 6, the arm part 7, and the base part 8 of the click button 5, the holding component 12, the main substrate 13, the connector 19, the connector plate 20, and the lower housing 16 are illustrated.

As illustrated in FIG. 9, the input part 2 is provided on the upper housing 11 so that the button parts 6 of the click buttons 5 are exposed from an opening of the upper housing 11. The button parts 6 of the click buttons 5 are each pressed down by a click by a user from a side of the upper housing 11 toward a side of the lower housing 16. Then the switch 18 is pressed down by the button part 6 pressed down. The switches 18, mounted on the holding component 12, reside on back side of the sectional view and are not illustrated in the sectional view.

The click buttons 5 include the arm parts 7 that support the button parts 6 and that are each curved by a click by a user and the base part 8 that includes the fixation parts 10 (illustrated in FIG. 2, for example) which are fixed to the upper housing 11. Fixation to the upper housing 11 with use of the fixation parts 10 is attained so that upper surfaces of the arm parts 7 and the base part 8 that are the support parts face the upper housing 11. When the button part 6 is pressed down, the arm parts 7 are curved and the contact part 9 of the button part 6 is thereby brought into contact with the switch 18. The lengths of the arm parts 7 are determined based on the distances from which the contact parts 9 of the button parts 6 are brought into contact with the switches 18, respectively.

One end of the holding component 12 provided with the switches 18 and fixed to the upper housing 11 extends to a border between the arm parts 7 and the base part 8 that is illustrated by a dotted line in the FIG. 9 and presses the base part 8. The main substrate 13 is fixed to the upper housing 11 so that the connector plate 20, having a top surface, of the connector 19 of the flexible cable 15 inserted into the connector of the main substrate 13 presses the holding component 12 including the one end and the base part 8 is thereby held so that only the arm parts 7 are curved upon a click by a user. Thus desired click feeling is attained.

A configuration with the holding component 12 and a configuration without the holding component 12 will be described with use of FIGS. 10 and 11.

Figure 10:
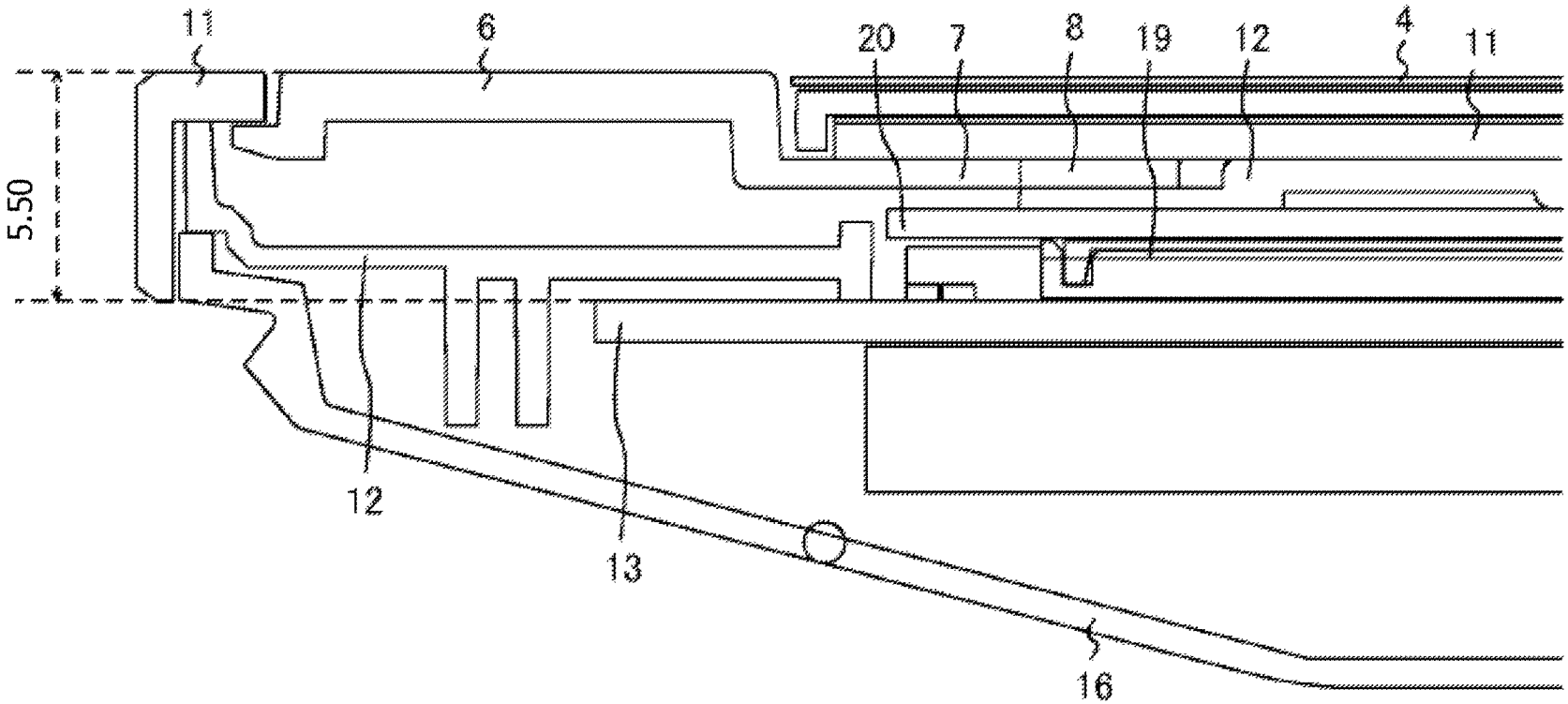
FIG. 10 is a side view illustrating the section of the input part.
Figure 11:
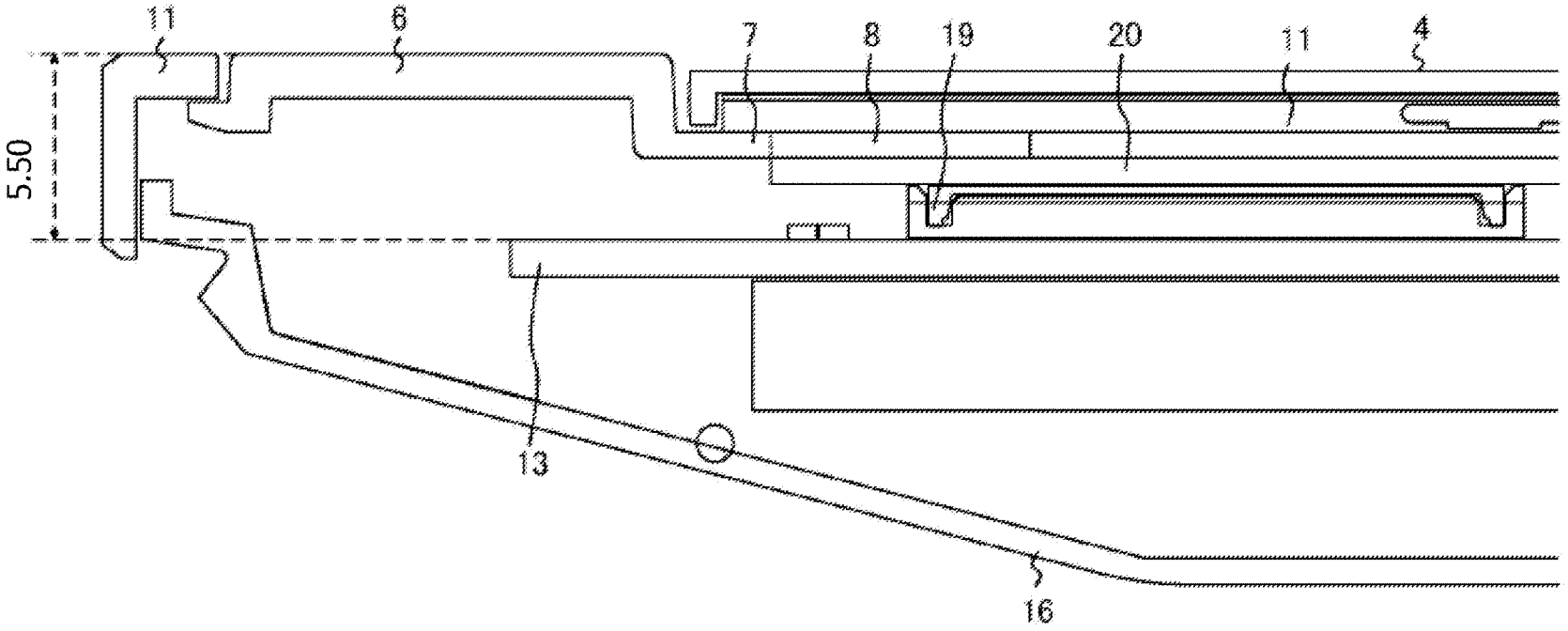
FIG. 11 is a side view illustrating the section of the input part.

FIG. 10 is a side view illustrating the section of the input part 2, as FIG. 9 illustrates, and illustrates the configuration with the holding component 12. In FIG. 10, the upper housing 11, the touch pad 4, the button part 6, the arm part 7, and the base part 8 of the click button 5, the holding component 12, the main substrate 13, the connector 19, the connector plate 20, and the lower housing 16 are illustrated. As illustrated in FIG. 10, the input part 2 includes the upper housing 11, the click buttons 5, the holding component 12, the main substrate 13 provided with the connector into which the connector 19 of the flexible cable 15 is inserted, and the lower housing 16. In the configuration provided with the holding component 12, the connector plate 20 thus presses the support part of the click buttons 5 through the holding component 12. Thickness from a top surface of the upper housing 11 to a top surface of the substrate in the configuration is 5.50 mm.

Subsequently, the input part 2 in the configuration without the holding component 12 will be described with use of FIG. 11. FIG. 11 is a side view illustrating the section of the input part 2. In FIG. 11, the upper housing 11, the touch pad 4, the button part 6, the arm part 7, and the base part 8 of the click button 5, the main substrate 13, the connector 19, the connector plate 20, and the lower housing 16 are illustrated. As illustrated in FIG. 11, the input part 2 includes the upper housing 11, the click buttons 5, the main substrate 13 provided with the connector into which the connector 19 of the flexible cable 15 is inserted, and the lower housing 16. In the configuration without the holding component 12, the connector plate 20 directly presses the support part of the click buttons 5. The one end of the connector plate 20 presses an area extending to the border between the arm parts 7 and the base part 8 that is illustrated by a dotted line in FIG. 11, so that only the arm parts 7 may be curved. The thickness from the top surface of the upper housing 11 to the top surface of the substrate in the configuration is 5.00 mm, and the input part 2 is accordingly made thinner than the input part 2 in the configuration with the holding component 12.

Figure 12:
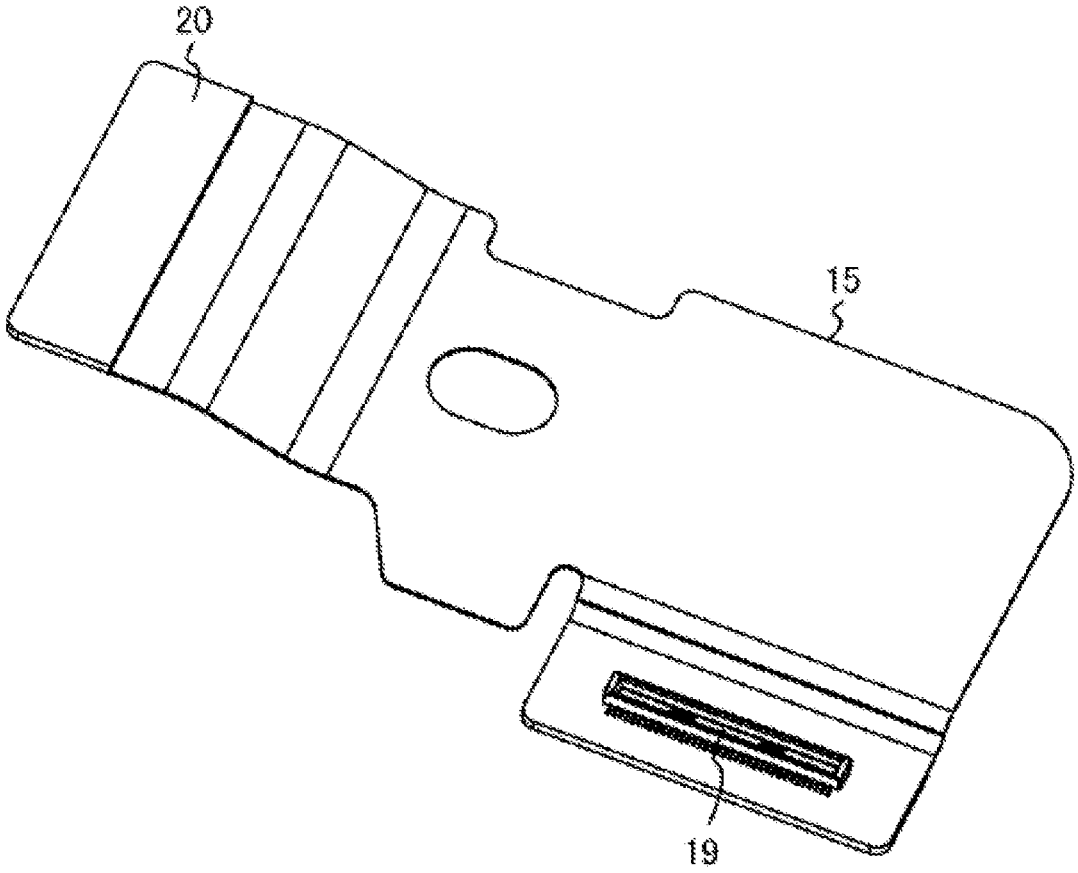
FIG. 12 is a diagram illustrating the flexible cable.

FIG. 12 is a diagram illustrating the flexible cable 15. The structure that presses the base part 8 of the click buttons 5 is not limited to the connector 19 of the flexible cable 15 and a component that is inserted and disconnected with respect to the substrate in the vertical directions and that demands the structure for holding from an element other than the substrate may be used therefor. Such a component as a button battery mounted on the substrate may be used therefor, for instance. In the embodiment, the flexible cable 15 is used as an example. As illustrated in FIG. 12, the flexible cable 15 has the connector 19 and the connector plate 20. The connector 19 is provided on a back face of the other connector plate of the two connector plates of the flexible cable 15. The connector plate 20 is provided on a back face of the other connector of the two connectors of the flexible cable 15. The connector plate 20 is provided at a position corresponding to the base part 8 of the click buttons 5 and thus presses the base part 8 when the main substrate 13 is assembled with the upper housing 11.

Figure 13:
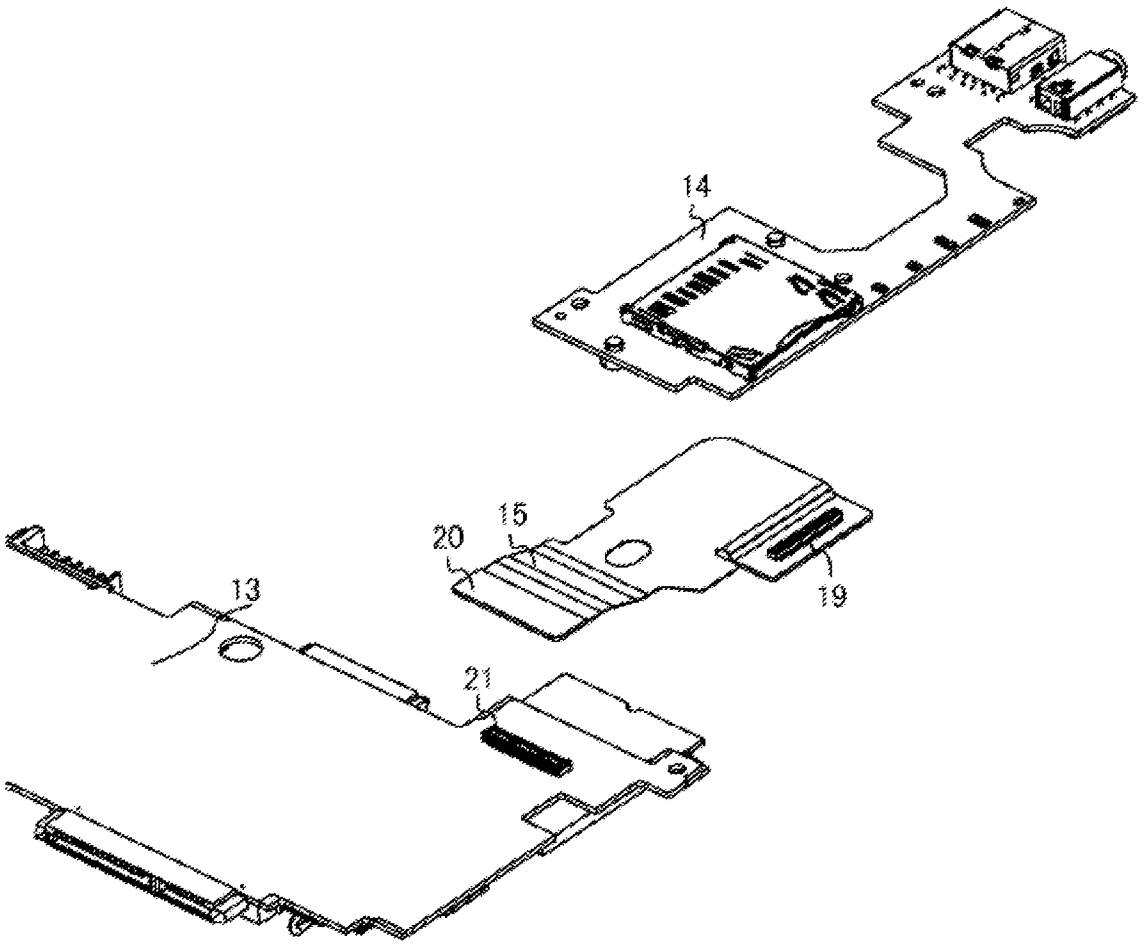
FIG. 13 is an assembly diagram illustrating the main substrate, the flexible cable, and a sub-substrate.

FIG. 13 is an assembly diagram illustrating the main substrate 13, the flexible cable 15, and the sub-substrate 14. In FIG. 13, the main substrate 13, the flexible cable 15, and the sub-substrate 14 are illustrated. The connector 19 provided on the connector plate 20 of the flexible cable 15 is inserted into the connector 21 provided on the main substrate 13. The other connector 19 of the flexible cable 15 is inserted into a connector provided on the sub-substrate 14.

Figure 14:
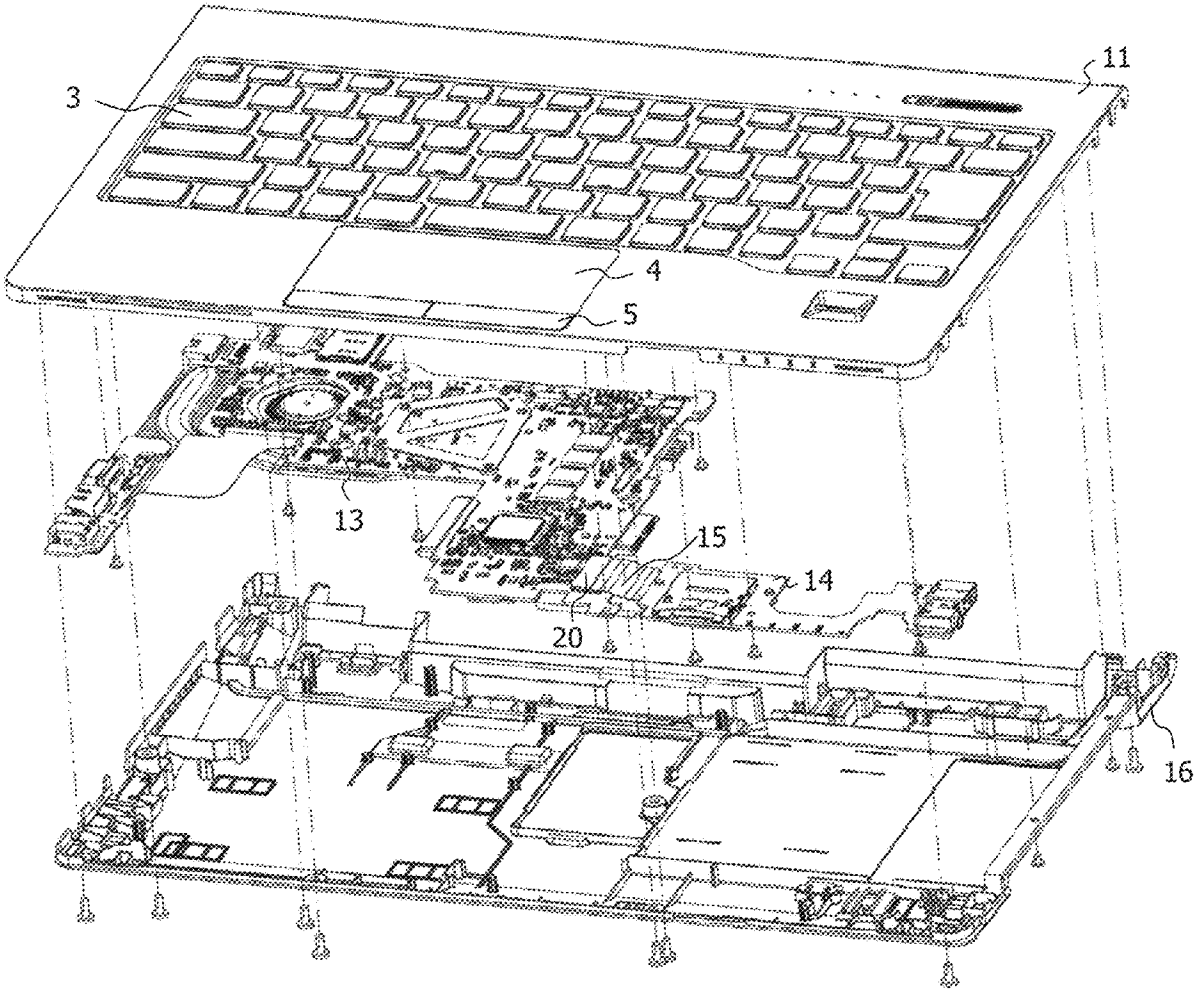
FIG. 14 is an assembly diagram illustrating the upper housing, the main substrate, the sub-substrate, and a lower housing.

FIG. 14 is an assembly diagram illustrating the upper housing 11, the main substrate 13, the sub-substrate 14, and the lower housing 16. As illustrated in FIG. 14, the upper housing 11 and the lower housing 16 house the main substrate 13 and the sub-substrate 14 connected to the main substrate 13 by the flexible cable 15. The main substrate 13 and the sub-substrate 14 are fixed to the upper housing 11 with use of screws. The upper housing 11 and the lower housing 16 are assembled and fixed by screws.

Figure 15:
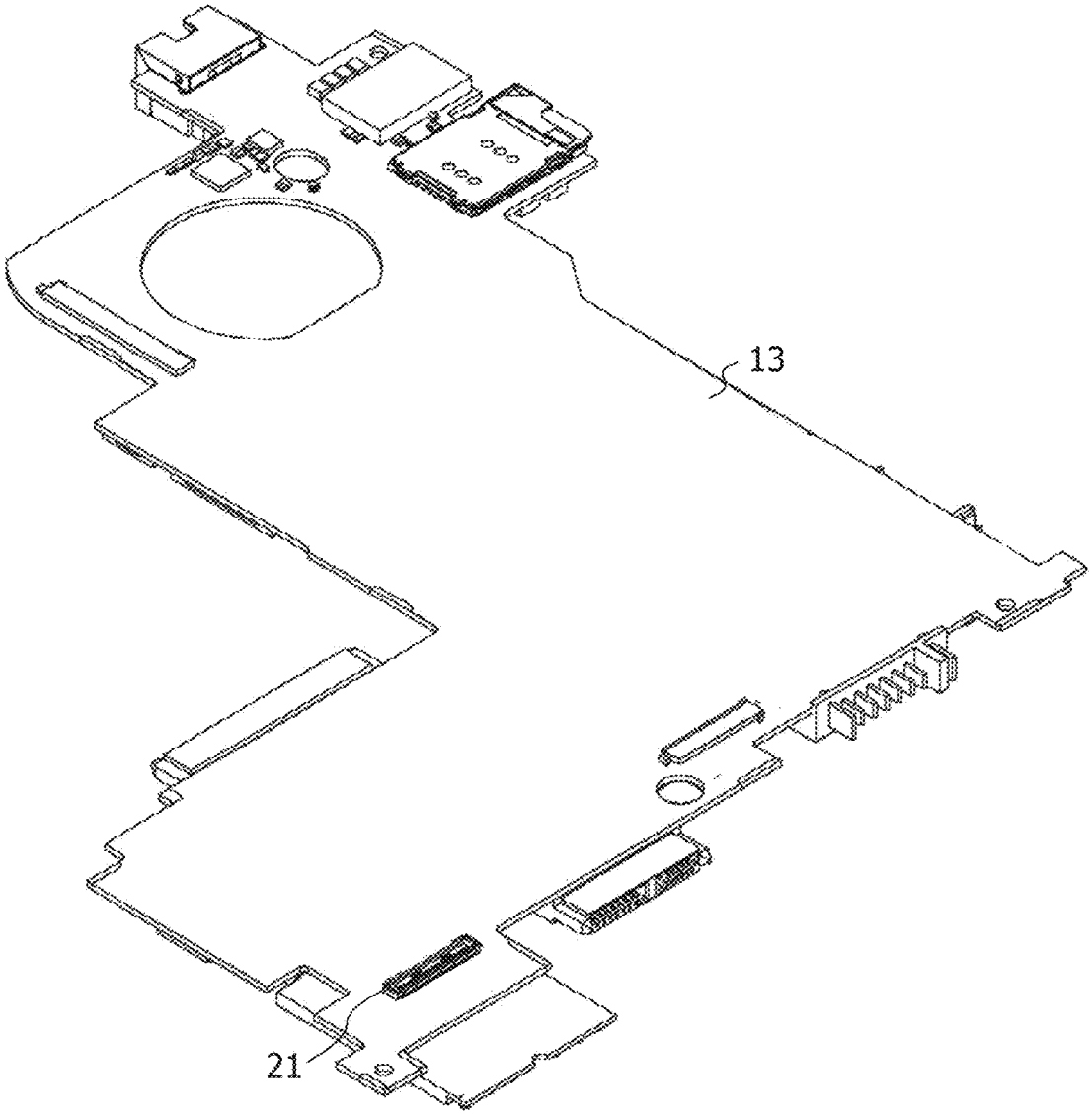
FIG. 15 is a schematic diagram illustrating the main substrate.

FIG. 15 is a schematic diagram illustrating the main substrate 13. As illustrated in FIG. 15, the main substrate 13 includes the connector 21 into and from which the connector 19 of the flexible cable 15 is inserted and disconnected in the vertical directions.

Figure 16:
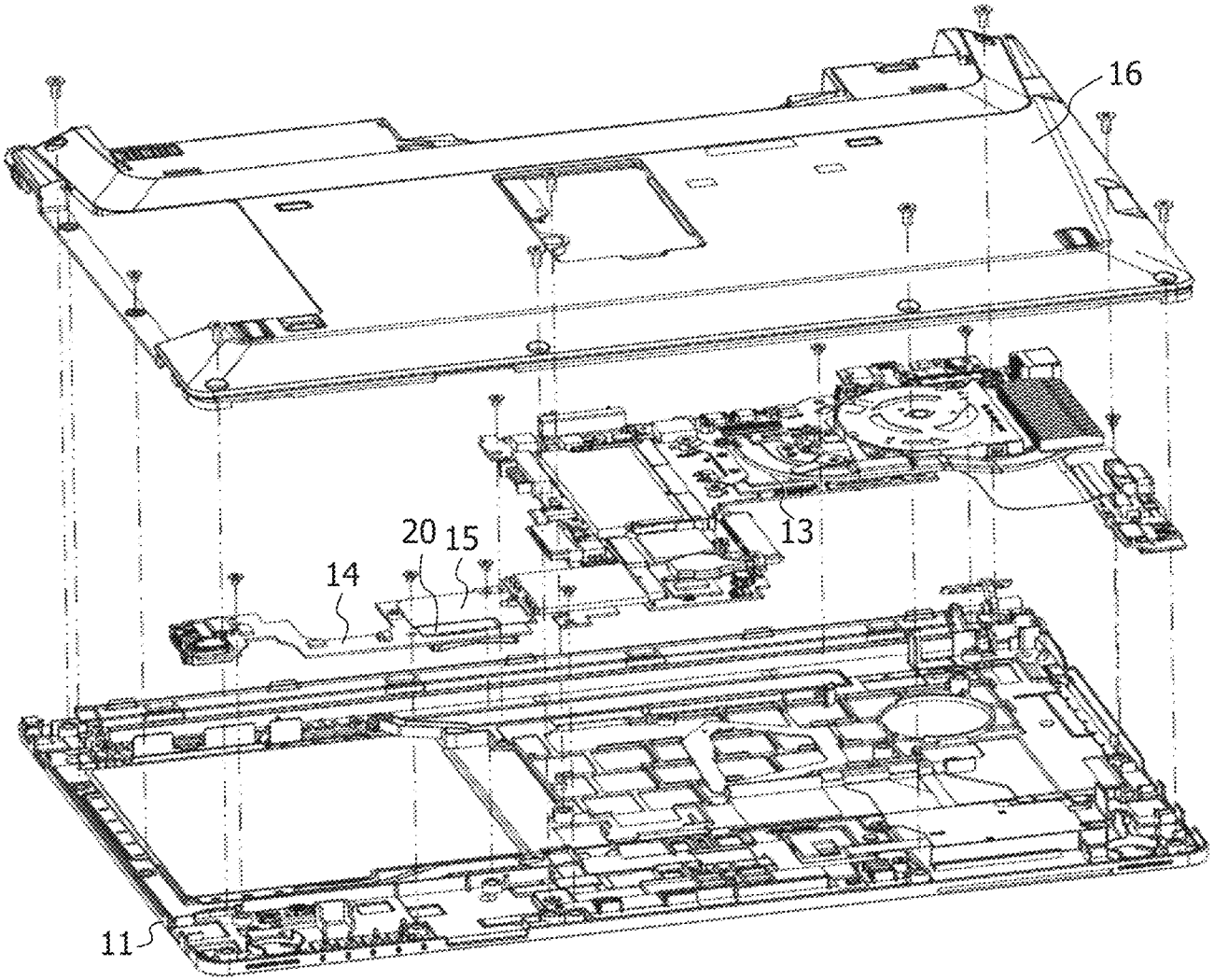
FIG. 16 is an assembly diagram illustrating the lower housing, the main substrate, the sub-substrate, and the upper housing.

FIG. 16 is an assembly diagram illustrating the lower housing 16, the main substrate 13, the sub-substrate 14, and the upper housing 11. FIG. 16 is a view as seen looking from the side of the lower housing 16, that is, from the back side. As illustrated in FIG. 16, the lower housing 16 and the upper housing 11 house the main substrate 13 and the sub-substrate 14 connected to the main substrate 13 by the flexible cable 15. The main substrate 13 and the sub-substrate 14 are fixed to the upper housing 11 with use of the screws.

The input device of the first embodiment enables stable click and effective utilization of substrate area.

Figure 17:
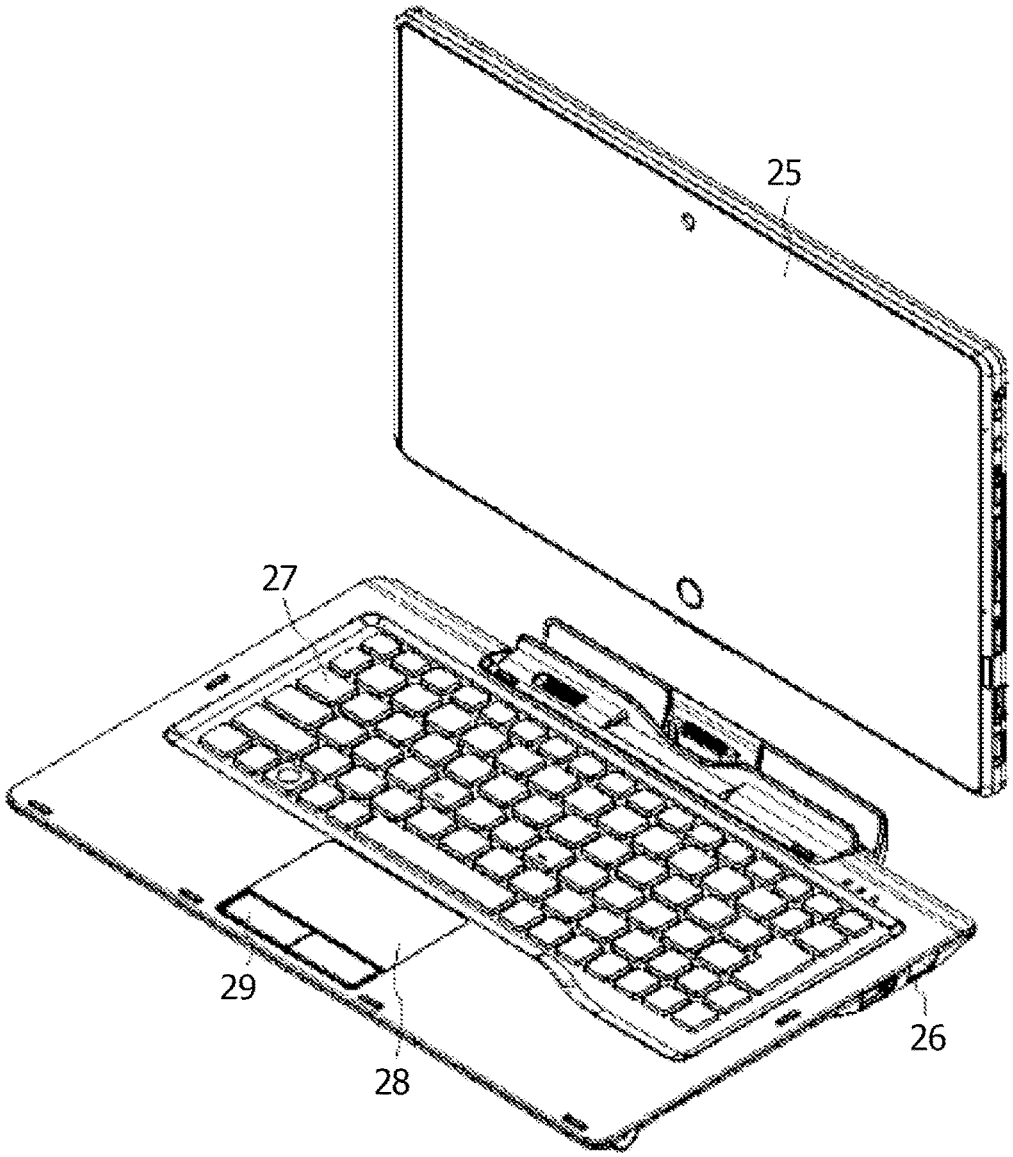
FIG. 17 is a diagram illustrating an input device that is separable from a display device.

As a second embodiment, an input device 26 that is separable from a display device 25 is illustrated in FIG. 17. As illustrated in FIG. 17, the display device 25 that displays a display screen is separable from the input device 26. The input device 26 includes a keyboard 27, a touch pad 28, and click buttons 29.

Though the embodiments discussed herein are applied to notebook-size PCs, tablet terminals, portable information terminals, and input devices separable from display devices, for instance, as the input devices and the electronic equipment, there is no limitation thereto.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An input device comprising:

a housing which has an opening;

button parts which are exposed from the opening and which are pressed down in a first direction;

a support component which has a support part to support the button parts, a first surface to face the housing, a second surface provided opposite to the first surface, and fixation parts provided at a first distance from the support part and fixed to the housing on a side of the first surface;

a first substrate which is provided so as to face the second surface of the support component;

a second substrate that is different from the first substrate; and a connector which is inserted into the first substrate in the first direction and which presses a specified area of the second surface, positioned at a second distance shorter than the first distance from the support part, toward the housing in a direction opposite to the first direction, the connector providing electrical connection between the first substrate and the second substrate.

2. The input device according to claim 1, further comprising:

switches which are provided at positions at a third distance from the button parts in the first direction and with which the button parts are brought into contact when the button parts are pressed down in the first direction, wherein the second distance is set based on the third distance from one end of the support part.

3. The input device according to claim 1, wherein the first substrate is fixed to the housing so as to press the specified area toward the housing.

4. The input device according to claim 1, wherein the support part includes a base part that has the fixation parts and curving parts that each have one end configured to support the button parts and the other end connected to the base part, and wherein the specified area includes parts of the base part to which the curving parts are connected.

5. The input device according to claim 1, wherein a touch pad is provided on the housing on a side opposite to a side to which the support part is fixed, wherein the support part includes a base part that has the fixation parts, at both ends, to be fixed to the housing outside an area where the touch pad is provided and curving parts that each have one end configured to support the button parts and the other end connected to the base part, and wherein the specified area includes parts of the base part to which the curving parts are connected.

6. Electronic equipment comprising:

an input device that includes a housing which has an opening, button parts which are exposed from the opening and which are pressed down in a first direction, a support component which has a support part to support the button parts, a first surface to face the housing, a second surface provided opposite to the first surface, and fixation parts provided at a first distance from the support part and fixed to the housing on a side of the first surface, a first substrate which is provided so as to face the second surface of the support component, a second substrate that is different from the first substrate, and a connector which is inserted into the first substrate in the first direction and which presses a specified area of the second surface, positioned at a second distance shorter than the first distance from the support part, toward the housing in a direction opposite to the first direction, the connector providing electrical connection between the first substrate and the second substrate; and a display device that displays a display screen.

* * * * *